US009186725B2

(12) United States Patent
Tamotsu

(10) Patent No.: US 9,186,725 B2
(45) Date of Patent: Nov. 17, 2015

(54) CARRIAGE TO TRANSPORT A LADLE AND TO TRANSFER MOLTEN METAL INTO EQUIPMENT FOR POURING AND TRANSPORTATION LINE FOR TRANSPORTING MOLTEN METAL

(75) Inventor: Hiroyuki Tamotsu, Nagoya (JP)

(73) Assignees: SINTOKOGIO, LTD., Nagoya-Shi (JP); FUJIWA DENKI CO., LTD., Nagoya-Shi (JP)

( * ) Notice: Subject to any disclaimer, the term of this patent is extended or adjusted under 35 U.S.C. 154(b) by 209 days.

(21) Appl. No.: 13/266,966

(22) PCT Filed: Mar. 24, 2010

(86) PCT No.: PCT/JP2010/055775

§ 371 (c)(1), (2), (4) Date: Oct. 28, 2011

(87) PCT Pub. No.: WO2010/128610

PCT Pub. Date: Nov. 11, 2010

(65) Prior Publication Data

US 2012/0043706 A1 Feb. 23, 2012

(30) Foreign Application Priority Data

May 8, 2009 (JP) ..... 2009-113183
Dec. 16, 2009 (JP) ..... 2009-284820

(51) Int. Cl.
*F27B 14/02* (2006.01)
*B22D 41/12* (2006.01)

(52) U.S. Cl.
CPC ..... *B22D 41/12* (2013.01)

(58) Field of Classification Search
CPC ..... B22D 39/00; B22D 41/04; B22D 41/06; B22D 41/12
USPC ..... 266/45, 236, 276
See application file for complete search history.

(56) References Cited

U.S. PATENT DOCUMENTS 2,857,156 A * 10/1958 Greffe ..... 266/233
3,257,105 A * 6/1966 Heemeyer ..... 164/417

(Continued)

FOREIGN PATENT DOCUMENTS

CN 1261830 A 2/2000
EP 1 967 302 A1 9/2008

(Continued)

OTHER PUBLICATIONS

International Search Report dated Aug. 26, 2010 issued in corresponding International Application No. PCT/JP2010/055775.

(Continued)

*Primary Examiner* — Scott Kastler
(74) *Attorney, Agent, or Firm* — Finnegan, Henderson, Farabow, Garrett & Dunner, L.L.P.

(57) ABSTRACT

The present invention provides a carriage to transport a ladle and to transfer molten metal into equipment for pouring (hereafter, transfer carriage) whereby the investment cost can be reduced by having the equipment made compact, and the temperature of the molten metal can be maintained high, and the cycle time can be reduced, because the time to transport the molten metal can be less. Further, the present invention provides a transportation line for transporting the molten metal. This line requires a smaller space for its installation. The transfer carriage of the present invention comprises a transportation means that runs along the rails for transporting a ladle; a shifting means disposed on the transportation means, which shifting means moves in the direction that is perpendicular to the rails for transporting a ladle; a lifting mechanism attached to a pillar set upright on the shifting means, a tilting means disposed at a lifting member of the lifting mechanism; and a ladle-holding member that is supported by the tilting means at the axis of the tilting means, which member is tilted by the tilting means, and which can hold or release a receiving ladle, wherein the carriage transfers the molten metal in the receiving ladle into the ladle for pouring.

4 Claims, 6 Drawing Sheets

(56) References Cited

U.S. PATENT DOCUMENTS

| | | | | |
|---|---|---|---|---|
| 6,619,371 | B1 | 9/2003 | Lauper | |
| 8,327,912 | B2 * | 12/2012 | Terada et al. | 164/136 |
| 8,506,876 | B2 * | 8/2013 | Suzuki et al. | 266/45 |

FOREIGN PATENT DOCUMENTS

| | | | |
|---|---|---|---|
| JP | 5-329622 | A | 12/1993 |
| JP | 6-007919 | A | 1/1994 |
| JP | 2004-230439 | A | 8/2004 |
| WO | WO 99/00205 | | 1/1999 |

OTHER PUBLICATIONS

Chinese Patent Office, "Office Action," Feb. 7, 2013, 2 pages.

* cited by examiner

CARRIAGE TO TRANSPORT A LADLE AND TO TRANSFER MOLTEN METAL INTO EQUIPMENT FOR POURING AND TRANSPORTATION LINE FOR TRANSPORTING MOLTEN METAL

FIELD OF THE INVENTION

This invention relates to a carriage used in a foundry. It transports a ladle that contains molten metal and transfers the molten metal to another ladle. It also relates to a transportation line for transporting the molten metal.

TECHNICAL BACKGROUND

Conventionally, in a foundry a cast product is manufactured by a process where molten metal that is melted in melting works is at first transported to pouring works, and there the molten metal is poured into a mold. A ladle is used as a container that transports the molten metal. There was a method to transport a ladle wherein the ladle first received the molten metal from the melting works and then it was transported by a crane to the pouring works where the molten metal was supplied to the equipment for pouring of the pouring works. (See Paragraph 0002 of Patent Document 1.)

PRIOR-ART DOCUMENT

Patent Document 1: Published Japanese patent application, Publication No. 2004-230439

SUMMARY OF THE INVENTION

Problem to be Solved

However, the method disclosed in Patent Document 1 has problems, for example, in that workers come close to a dangerous area of the molten metal, which has a high temperature, or there is a chance that the lifted ladle might accidentally fall. Because of these problems a method to transport the ladle by a carriage that runs on the ground or to transport the ladle by a roller conveyor has been introduced. But the method has its own defects, for example, of the kinds in which the investment cost becomes higher if the installation of the plant becomes complex, depending on the layout of a melting furnace and equipment for pouring, and in which the temperature of the molten metal drops or the cycle time for pouring the molten metal becomes longer because the time required for the transport becomes longer.

To solve these problems, the present invention provides a carriage to transport a ladle and to transfer molten metal into equipment for pouring (hereafter, transfer carriage) whereby the investment cost can be reduced by having the equipment made compact, and the temperature of the molten metal can be maintained high, and the cycle time can be reduced, because the time to transport the molten metal can be less.

Further, the present invention provides a transportation line for transporting the molten metal. This line requires a smaller space for its installation.

Means to Solve Problems

The transfer carriage of the present invention comprises a transportation means that runs along the rails for transporting a ladle; a shifting means disposed on the transportation means, which shifting means moves in the direction that is perpendicular to the rails for transporting a ladle; a lifting mechanism attached to a pillar set upright on the shifting means, a tilting means disposed at a lifting member of the lifting mechanism; and a ladle-holding member that is supported by the tilting means at the axis of the tilting means, which member is tilted by the tilting means, and which can hold or release a receiving ladle, wherein the carriage transfers the molten metal in the receiving ladle into the ladle for pouring.

The transportation line for transporting the molten metal of the present invention uses the transfer carriage that transports the receiving ladle along the rails for transporting a ladle, which receiving ladle has received the molten metal from the melting works, and which line transfers the molten metal in the ladle for pouring of the equipment for pouring.

Effects of the Invention

The transportation line for transporting molten metal of the present invention can produce effects such as reducing the investment cost by minimizing the size of the equipment, maintaining the temperature of the molten metal, and reducing the cycle time by shortening the time for transporting the molten metal. Further, by introducing the transportation line for transporting the molten metal of the present invention the space for the transportation line can be minimized.

BEST MODE FOR CARRYING OUT THE INVENTION

Below the transfer carriage in one embodiment of the present invention is explained based on the drawings.

Figure 1:
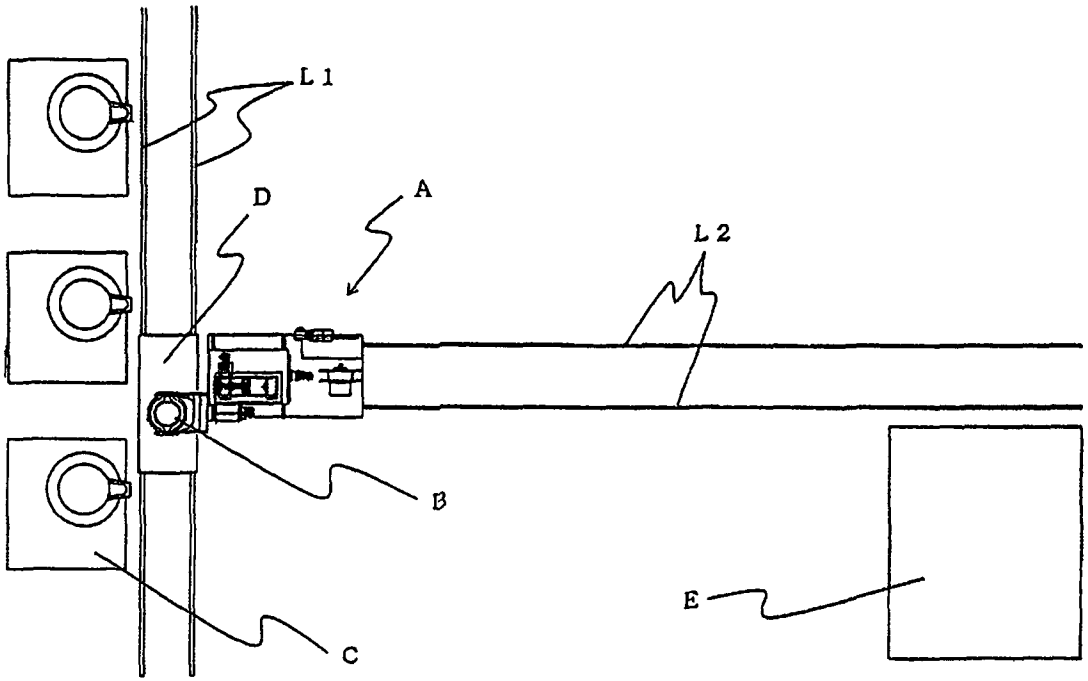
FIG. 1 is a schematic view of a transportation line for transporting molten metal using a transfer carriage and a receiving carriage, in one embodiment of the present invention.

FIG. 1 is a schematic view of the transportation line for transporting molten metal using a transfer carriage and a receiving carriage in one embodiment of the present invention.

As shown in FIG. 1, the transportation line for transporting molten metal is constituted in a way such that the rails for the receiving ladle that receives the molten metal (hereafter "rails for the receiving ladle") L1 are laid in front of the melting works C, and the rails for transporting a ladle L2 are laid in the direction that is perpendicular to the rails for the receiving ladle L1, on which the receiving carriage D runs. Also, the rails for transporting a ladle L2 are laid alongside the pouring works E. The transfer carriage A runs on the rails for transporting a ladle L2.

Figure 2:
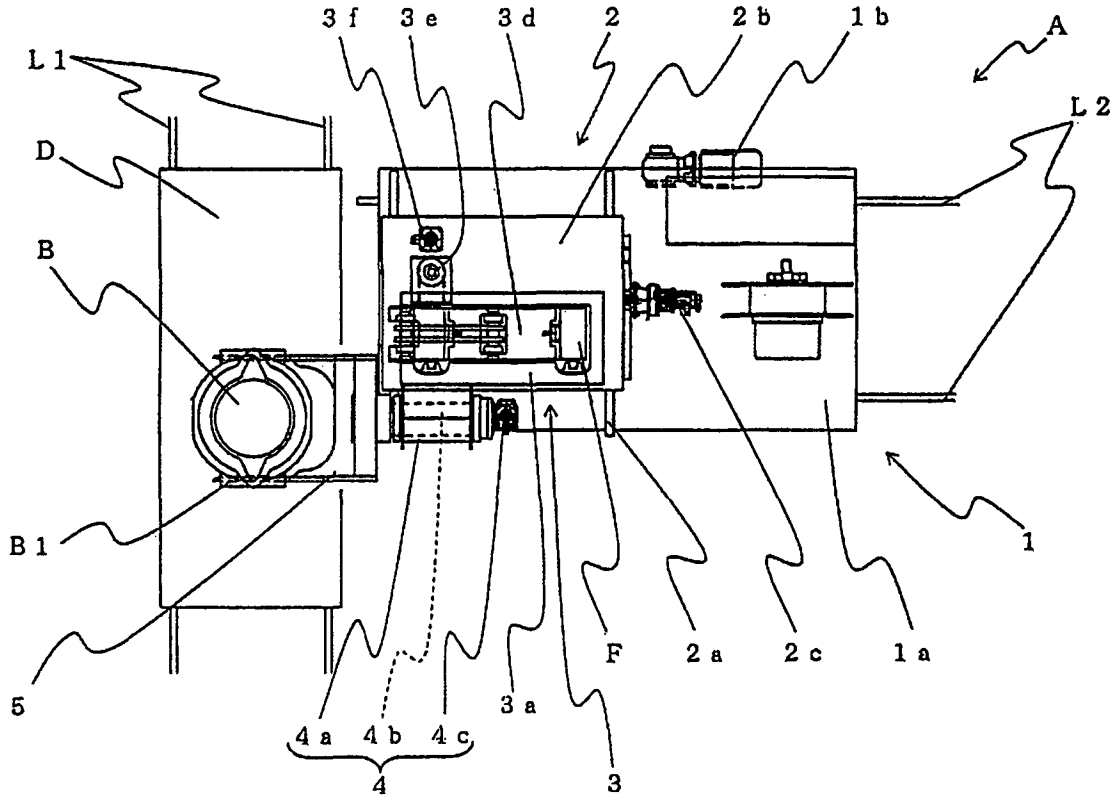
FIG. 2 is a schematic plan view of the transfer carriage changing a ladle that is on the receiving carriage, in one embodiment of the present invention.
Figure 3:
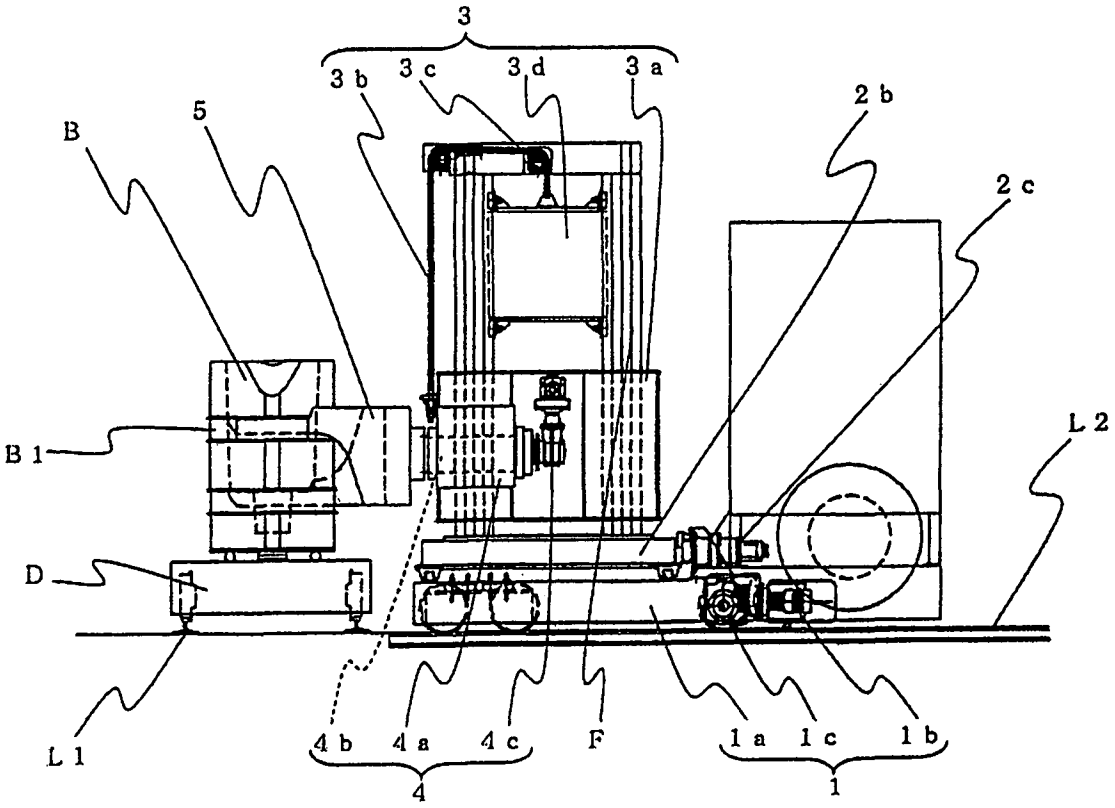
FIG. 3 is a schematic front view of the transfer carriage changing the ladle that is on the receiving carriage, in one embodiment of the present invention.

FIGS. 2 and 3 illustrate how the transfer carriage replaces the ladle on the receiving carriage. In FIGS. 2 and 3, the receiving ladle B is placed at a fixed position on the receiving carriage D. The transfer carriage A is disposed in the direction that is perpendicular to the receiving carriage D. Also, the transfer carriage A is disposed at such a position that the ladle-holding member 5 can be inserted into a receiving part B1 of the receiving ladle B that is on the receiving carriage D The transportation means 1 of the transfer carriage A comprises a transport carriage 1*a*, a driving device for a carriage 1*b*, and wheels 1*c*. On the side of the transport carriage 1*a* is installed a driving device for a carriage 1*b* that runs the transfer carriage A on the rails for transporting a ladle L2 by driving the wheels 1*c*.

Further, the shifting means 2 is disposed on the upper deck of the transport carriage 1*a*. The shifting means 2 comprises rails for shifting 2*a* that are laid in the direction that is perpendicular to the rails for transporting a ladle L2, a carriage for shifting 2*b* disposed on the rails for shifting 2*a*, and a driving device for shifting 2*c* that moves the carriage for shifting 2*b*. The carriage for shifting 2*b* is movable on the transport carriage 1*a*. The carriage for shifting 2*b* is driven by the driving device for shifting 2*c* in the direction that is perpendicular to the rails for transporting a ladle L2.

A pillar F is set upright on the upper surface of the carriage for shifting 2*b* of the shifting means 2. A lifting mechanism 3 is attached to the pillar F. The lifting mechanism 3 comprises a frame for lifting 3*a*, a chain 3*b*, a chain wheel 3*c*, a balance weight 3*d*, a ball screw for lifting 3*e*, and a driving device for lifting 3*f*. The frame for lifting 3*a* is connected to the balance weight 3*d* via the chain 3*b* along the chain wheel 3*c*. The frame for lifting 3*a* moves up and down by means of the ball screw for lifting 3*e* being rotated by the driving device for lifting 3*f*.

The tilting means 4 comprises bearings for tilting axis 4*a*, a tilting axis 4*b*, and a driving device for tilting 4*c*. The bearings for tilting axis 4*a* are fixed to the frame for lifting 3*a* and support the tilting axis 4*b* in a way such that the tilting axis 4*b* can tilt freely. The driving device for tilting 4*c* tilts the tilting axis 4*b*.

The ladle-holding member 5 is fixed to the end of the tilting axis 4*b*. The ladle-holding member 5 has a shape (e.g., a fork) such that it can be inserted into and removed from the receiving part B1 of the receiving ladle B. The ladle-holding member 5 rotates together with the tilting axis 4*b* driven by the driving device for tilting 4*c*.

Below is explained the movement of the transfer carriage A thus constituted.

As shown in FIG. 1, for the transportation line for transporting molten metal, the receiving carriage D, after receiving molten metal in the receiving ladle B that it carries from the melting works C, runs to and stops at the position of transfer, where the transfer carriage A receives the receiving ladle B. By the position of transfer is meant the position where the transfer carriage A is placed perpendicular to the receiving carriage D and where the ladle-holding member 5 can be inserted into the receiving part B1 of the receiving ladle B, which is carried on the receiving carriage D.

In the present embodiment, the receiving carriage D is used to carry the receiving ladle B that receives molten metal from the melting works C. But the molten metal can be poured into the receiving ladle B, which is held by the transfer carriage A without the use of the receiving carriage D. In this case, the concept of the position of transfer does not exist. Also, a roller conveyor, a lifting mechanism for the roller conveyor, and a device for opening and closing the lid of the ladle, etc., can be attached to the receiving carriage D. Also, a dust collector can be installed on the receiving carriage D.

When the receiving carriage D stops at the position of transfer, the transfer carriage A moves forward and inserts the ladle-holding member 5 into the receiving part B1, as shown in FIGS. 2 and 3.

Figure 4:
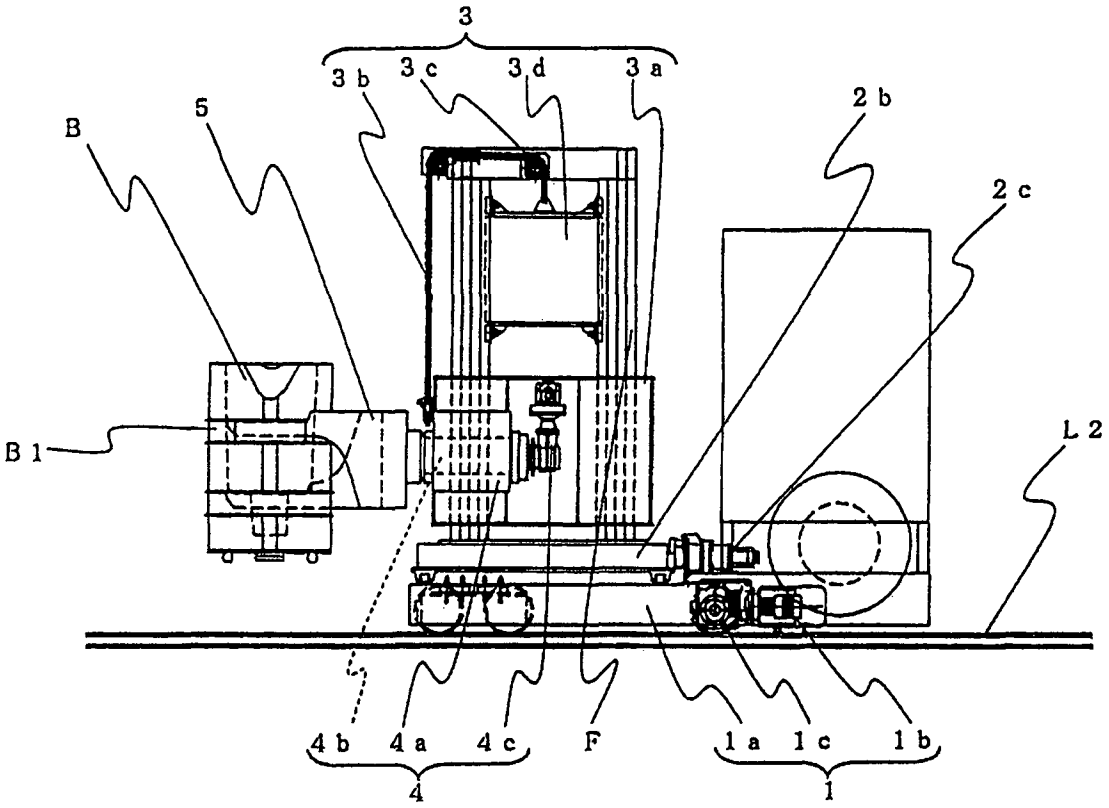
FIG. 4 is a schematic front view of the transfer carriage transporting a ladle, in one embodiment of the present invention.
Figure 5:
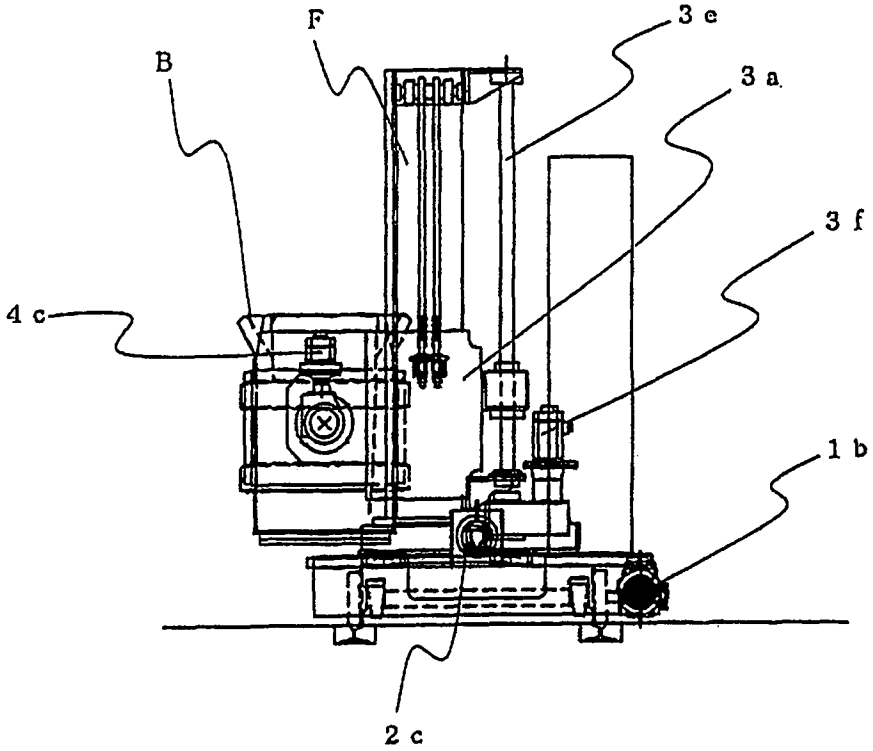
FIG. 5 is a schematic left-side view of the transfer carriage transporting a ladle, in one embodiment of the present invention.

Next, as shown in FIGS. 4 and 5, the transfer carriage A lifts the receiving ladle B with the driving device for lifting 3*f* and runs on the rails for transporting a ladle L2 driven by the driving device for a carriage 1*b* and stops at the pouring works E.

Figure 6:
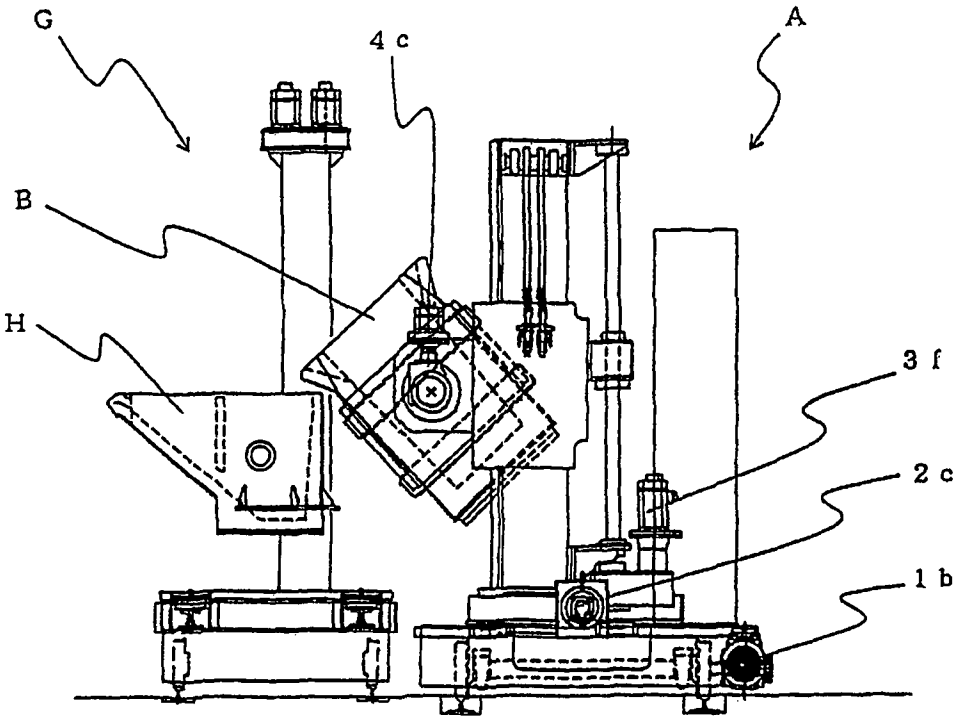
FIG. 6 is a schematic left-side view of the transfer carriage transferring the molten metal into the ladle for pouring placed on the equipment for pouring, in one embodiment of the present invention.

At the pouring works E, as shown in FIG. 6, the equipment for pouring G, disposed at the left-hand side of FIG. 6, completes the pouring and holds the ladle for pouring H ready for a next pouring. Then the molten metal in the receiving ladle B is poured into the ladle for pouring H by the ladle for pouring B being tilted in a movement that is coordinated with the movements of the driving device for shifting 2*c*, driving device for lifting 3*f*, and driving device for tilting 4*c*.

Next, the transfer carriage A returns to the position where it is ready for transport, as shown in FIGS. 4 and 5, and then runs to the position of transfer where it stops.

Next, the transfer carriage A places the receiving ladle B on the receiving carriage D by having the receiving ladle B lowered by the driving device for lifting 3*f*. The transfer carriage A then moves backward, driven by the driving device for a carriage 1*b*, and pulls out the ladle-holding member 5 that is inserted in the receiving part B1 of the receiving ladle B.

The receiving carriage D is now kept on standby for a next pouring. The transfer carriage A is also kept on standby for the next pouring, the transport of the molten metal, and the transfer of the molten metal.

As explained above, the transfer carriage of the present invention can carry out by itself all the work of receiving the receiving ladle that receives the molten metal on the receiving carriage, transporting it, and then pouring the molten metal into the ladle for pouring that is disposed on the equipment for pouring. The transportation line for transporting the molten metal of the present embodiment has a T-shape, but it can be formed as an I-shape, L-shape, etc. The present invention is not limited to the embodiment illustrated in the specification. It should be understood that various modifications can be made to the inventions of the claims without departing from the spirit of the present inventions. Therefore such modifications and variations are considered to be within the scope of this invention as defined by the claims.

The basic Japanese Patent Applications, No. 2009-113183, filed May 8, 2009, and No. 2009-284820, filed Dec. 16, 2009, are hereby incorporated by reference in their entireties in the present application.

The present invention will become more fully understood from the detailed description of this specification. However, the detailed description and the specific embodiment illustrate desired embodiments of the present invention and are given only for an explanation. Various possible changes and modifications will be apparent to those of ordinary skill in the art on the basis of the detailed description.

The applicant has no intention to dedicate to the public any disclosed embodiments.

Among the disclosed changes and modifications, those that may not literally fall within the scope of the present claims constitute, therefore, a part of the present invention in the sense of the doctrine of equivalents.

SYMBOLS transportation means
1*a* transport carriage
1*b* driving device for a carriage
1*c* wheel(s)
2 shifting means
2*a* rails for shifting
2*b* carriage for shifting
2*c* driving device for shifting
3 lifting mechanism
3*a* frame for lifting
3*b* chain
3*c* chain wheel
3*d* balance weight
3*e* ball screw for lifting
3*f* driving device for lifting
4 tilting means
4*a* bearings for tilting axis
4*b* tilting axis
4*c* driving device for tilting
5 ladle-holding member
A carriage to transport a ladle and to transfer molten metal into equipment for pouring
B receiving ladle
B1 receiving part
C melting works
D receiving carriage
E pouring works
F pillar
G equipment for pouring
H ladle for pouring
L1 rails for the receiving ladle that receives the molten metal
L2 rails for transporting a ladle

The invention claimed is:

1. A transportation line for transporting molten metal, using a transfer carriage that transports a receiving ladle along rails for transporting a ladle (L2), which receiving ladle has received the molten metal from melting works, and which line transfers the molten metal in a ladle for pouring of pouring works, wherein
the transportation line for transporting molten metal is constituted in a way such that the rails for the receiving ladle (L1) that receives the molten metal are laid in front of the melting works, and the rails for transporting a ladle (L2) that are laid alongside the pouring works are laid in the direction that is perpendicular to the rails for the receiving ladle (L1),
wherein
the rails for transporting a ladle (L2) form a T-shape or an L-Shape in relation to the rails for the receiving ladle (L1), and
wherein
the transfer carriage comprises:
a transportation means that runs along the rails for transporting a ladle (L2);
a shifting means disposed on the transportation means, which shifting means moves in the direction that is perpendicular to the rails for transporting a ladle (L2);
a lifting mechanism attached to a pillar that is set upright on the shifting means;
a tilting means that is disposed at a lifting member of the lifting mechanism; and
a ladle-holding member that is supported by the tilting means at the axis of the tilting means, which member is tilted by the tilting means, and which can hold or release a receiving ladle,
wherein the carriage is adapted to transfer the molten metal of the receiving ladle into a ladle for pouring.

2. The transportation line for transporting the molten metal of claim 1, wherein the transfer carriage runs on the rails for transporting a ladle (L2).

3. The transportation line for transporting molten metal of claim 1, wherein a shifting means comprising rails for shifting that are laid in the direction that is perpendicular to the rails for transporting a ladle (L2), a carriage for shifting disposed on the rails for shifting, and a driving device for shifting that moves the carriage for shifting, the carriage for shifting being movable on a transport carriage, which carriage for shifting is driven by the deriving device for shifting in the direction that is perpendicular to the trails for transporting a ladle (L2).

4. The transportation line for transporting molten metal of claim 1, wherein a receiving carriage that receives molten metal from the melting works in the receiving ladle that it carries has a dust collector installed on it.

* * * * *